US010290947B2

(12) United States Patent
Long et al.

(10) Patent No.: US 10,290,947 B2
(45) Date of Patent: May 14, 2019

(54) BEAM SCANNING ANTENNA, MICROWAVE SYSTEM, AND BEAM ALIGNMENT METHOD

(71) Applicant: Huawei Technologies Co., Ltd., Shenzhen (CN)

(72) Inventors: Hao Long, Chengdu (CN); Fusheng Tang, Segrate (IT); Zhuo Zeng, Chengdu (CN); Yanxing Luo, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 98 days.

(21) Appl. No.: 15/432,687

(22) Filed: Feb. 14, 2017

(65) Prior Publication Data

US 2017/0162945 A1 Jun. 8, 2017

Related U.S. Application Data

(63) Continuation of application No. PCT/CN2014/084383, filed on Aug. 14, 2014.

(51) Int. Cl.

| | |
|---|---|
| ***H01Q 3/24*** | (2006.01) |
| ***H01Q 15/14*** | (2006.01) |
| ***H01Q 3/40*** | (2006.01) |
| *H01Q 19/10* | (2006.01) |

(52) U.S. Cl.

CPC ..... *H01Q 15/14* (2013.01); *H01Q 3/24* (2013.01); *H01Q 3/40* (2013.01); *H01Q 19/10* (2013.01)

(58) Field of Classification Search

None

See application file for complete search history.

(56) References Cited

U.S. PATENT DOCUMENTS 3,340,531 A * 9/1967 Kefalas ..... G01S 3/42 455/13.1
4,342,036 A 7/1982 Scott et al.
5,175,562 A * 12/1992 Rappaport ..... H01Q 19/12 343/840

(Continued)

FOREIGN PATENT DOCUMENTS

CN 1909285 A * 2/2007 ..... H04B 1/18
CN 1909285 A 2/2007

(Continued)

*Primary Examiner* — Lana N Le

(74) *Attorney, Agent, or Firm* — Leydig, Voit & Mayer, Ltd.

(57) ABSTRACT

A beam scanning antenna, a microwave system, and a beam alignment method are disclosed. The method includes: instructing, by a switching control module, a feed switching module to enable each feed in a multi-feed antenna, so that the feeds separately perform signal quality detection, where the multi-feed antenna includes an aperture unit and at least two feeds, where the feeds are configured to radiate an electromagnetic wave signal, the feed switching module includes multiple switches, and each feed is respectively connected to one switch in the feed switching module; acquiring, by the switching control module, a result of the signal quality detection performed by each feed; and selecting, by the switching control module according to the result of the signal quality detection, one feed having the best signal quality as a working feed.

20 Claims, 5 Drawing Sheets

(56) References Cited

U.S. PATENT DOCUMENTS 5,859,619 A * 1/1999 Wu ..... H01Q 19/192 343/781 CA
6,061,033 A * 5/2000 Hulderman ..... H01Q 3/16 343/761
6,556,168 B1 * 4/2003 Marumoto ..... H01Q 21/0087 342/372
6,587,699 B2 * 7/2003 Olsen ..... G01V 8/005 455/562.1
6,642,908 B2 * 11/2003 Pleva ..... B60K 31/0008 343/700 MS
7,161,549 B1 * 1/2007 Cuchanski ..... H01Q 1/288 343/781 CA
7,193,562 B2 * 3/2007 Shtrom ..... H01Q 1/38 343/700 MS
8,604,989 B1 * 12/2013 Olsen ..... H01Q 25/008 343/754
2008/0122683 A1 * 5/2008 Howley ..... G01S 3/04 342/149
2013/0203364 A1 * 8/2013 Darnell ..... H01Q 1/243 455/77
2015/0084820 A1 * 3/2015 Ahn ..... H01Q 13/02 343/779
2015/0097727 A1 * 4/2015 Ozaki ..... G01S 19/24 342/357.63
2016/0013550 A1 * 1/2016 Artemenko ..... H01Q 3/245 455/15
2016/0025858 A1 * 1/2016 Yokooji ..... G01S 19/13 342/357.51

FOREIGN PATENT DOCUMENTS

CN 102738582 A 10/2012
WO 2012161612 A1 11/2012
WO 2013058673 A1 4/2013
WO WO-2013058673 A1 * 4/2013 ..... H01Q 1/1257

* cited by examiner

BEAM SCANNING ANTENNA, MICROWAVE SYSTEM, AND BEAM ALIGNMENT METHOD

CROSS-REFERENCE TO RELATED APPLICATIONS

This application is a continuation of International Application No. PCT/CN2014/084383, filed on Aug. 14, 2014, the disclosure of which is hereby incorporated by reference in its entirety.

TECHNICAL FIELD

The present application relates to the communications field, and in particular, to a beam scanning antenna, a microwave system, and a beam alignment method.

BACKGROUND

In a microwave communication application, a high-gain antenna is usually used to achieve a longer transmission distance or to avoid interference. However, a high-gain antenna has an excessively small beam angle, and alignment is very difficult during installation. In addition, in a case of a strong wind or the like, slight shakes of an antenna may cause a link interruption.

In the prior art, a device of an antenna is installed on a microwave tower that can hardly shake, and is reinforced by using a reinforcement apparatus.

However, in an actual application, installation environments are relatively limited for a microwave tower, which is not feasible in all scenarios. For example, during application in an urban area, it is possible that a microwave tower can only be installed on a pole or a rooftop. Moreover, on a microwave tower, both alignment difficulty and installation costs are increased for working personnel to install an antenna.

SUMMARY

Embodiments of the present application provide a beam scanning antenna, a microwave system, and a beam alignment method, which are used to resolve problems that installation costs of an antenna are high and a microwave link is easily affected by shakes.

In the embodiments of the present application, a first aspect provides a beam scanning antenna, including:

a multi-feed antenna, a feed switching module, and a switching control module, where the multi-feed antenna includes an aperture unit and at least two feeds, where the feeds are configured to radiate an electromagnetic wave signal, and the aperture unit is configured to focus the electromagnetic wave signal by means of reflection or refraction;

the feed switching module includes multiple switches, where each feed is respectively connected to one switch; and the switching control module is connected to the feed switching module, and the switching control module is configured to enable, by using the feed switching module, each feed to perform signal quality detection, and select one feed having the best signal quality as a working feed.

In a first possible implementation manner of the first aspect, the switching control module further includes:

a beam tracking module, configured to detect whether the feed having the best signal quality changes, and if yes, notify the beam alignment module to select one feed having the best signal quality as the working feed.

With reference to the first possible implementation manner of the first aspect, in a second possible implementation manner, the beam tracking module is specifically configured to: instruct, at an interval of preset duration, the feed switching module to traverse the feeds, so that each enabled feed separately performs signal quality detection, and determines, according to a result of the signal quality detection, whether the feed having the best signal quality changes; or receive a user instruction, and instruct, according to the user instruction, the feed switching module to traverse the feeds, so that each enabled feed separately performs signal quality detection, and determines, according to a result of the signal quality detection, whether the feed having the best signal quality changes; or monitor received signal quality in real time, and when it is detected that received signal quality of a current working feed is less than a preset threshold, instruct the feed switching module to traverse the feeds, so that each enabled feed separately performs signal quality detection, and determines, according to a result of the signal quality detection, whether the feed having the best signal quality changes.

In a third possible implementation manner of the first aspect, the at least two feeds include one first feed and at least one second feed;

the first feed is placed at a focal point of the aperture unit, and after being reflected or refracted by the aperture unit, a beam sent by the first feed is parallel to the axis of the aperture unit; and the second feed is placed at a periphery of the first feed, and after a beam sent by the second feed is reflected or refracted by the aperture unit, an angle is formed between the beam and the axis of the aperture unit.

With reference to the third possible implementation manner of the first aspect, in a fourth possible implementation manner, centers of the second feeds are evenly placed on a circle perpendicular to the axis of the aperture unit, the center of the circle is located on the axis of the aperture unit, a distance between a projection of the second feed on a focal plane and the focal point is R, the focal plane is a plane that is perpendicular to the axis of the aperture unit and at which the focal point is located, the center distance between two adjacent second feeds is d, radiation apertures of the second feeds are on a same plane, a distance between the radiation apertures of the second feeds and a radiation aperture of the first feed is δ, and δ is greater than or equal to zero.

With reference to the fourth possible implementation manner of the first aspect, in a fifth possible implementation manner, $$R \text{ meets: } R \le F \times \tan\left\{\theta \times \frac{1 + k[D/(4F)]^2}{1 + [D/(4F)]^2}\right\}; \text{ and}$$

$$d \text{ meets: } d \le \sqrt{2(R^2 + F^2) - 2(R^2 + F^2)\cos(\theta/2 + \phi/2)},$$

where

F is the focal length of the aperture unit, D is the diameter of the aperture unit, k is a constant less than or equal to 1, ϕ is a beam angle of an aperture radiation beam of the second feed, and θ is a beam angle of an aperture radiation beam of the first feed.

With reference to the third possible implementation manner of the first aspect, in a sixth possible implementation manner, two groups of second feeds are included, where centers of a first group of second feeds are evenly placed on a first circle perpendicular to the axis of the aperture unit, the center of the first circle is located on the axis of the aperture unit, a distance between a projection of any second feed in the first group of second feeds on a focal plane and the focal point is $R_1$, the center distance between two adjacent second feeds on the first circle is $d_1$, and a distance between radiation apertures of the first group of second feeds and a radiation aperture of the first feed is $\delta_1$; centers of a second group of second feeds are evenly placed on a second circle perpendicular to the axis of the aperture unit, the center of the second circle is located on the axis of the aperture unit, a distance between a projection of any second feed in the second group of second feeds on the focal plane and the focal point is $R_2$, the focal plane is a plane that is perpendicular to the axis of the aperture unit and at which the focal point is located, the center distance between two adjacent second feeds on the second circle is $d_2$, and a distance between the radiation apertures of the second group of second feeds and the radiation aperture of the first feed is $\delta_2$; and $\delta_1$ and $\delta_2$ are greater than or equal to zero.

With reference to the sixth possible implementation manner of the first aspect, in a seventh possible implementation manner, $$R_1 \text{ meets: } R_1 \le F \times \tan\left\{\theta \times \frac{1 + k[D/(4F)]^2}{1 + [D/(4F)]^2}\right\};$$

$$R_2 \text{ meets: } R_2 \le F \times \tan\left\{\theta \times \frac{1 + k[D/(4F)]^2}{1 + [D/(4F)]^2}\right\};$$

$$d_1 \text{ meets: } d_1 \leqq \sqrt{2(R_1^2 + F^2) - 2(R_1^2 + F^2)\cos(\theta/2 + \phi_1/2)}; \text{ and}$$

$$d_2 \text{ meets: } d_2 \leqq \sqrt{2(R_2^2 + F^2) - 2(R_2^2 + F^2)\cos(\theta/2 + \phi_2 + 2)},$$

where

F is the focal length of the aperture unit, D is the diameter of the aperture unit, k is a constant less than or equal to 1, $\phi_1$ is a beam angle of an aperture radiation beam of the first group of second feeds, $\phi_2$ is a beam angle of an aperture radiation beam of the second group of second feeds, and $\theta$ is a beam angle of an aperture radiation beam radiated by the first feed.

With reference to the third possible implementation manner of the first aspect, in an eighth possible implementation manner, n groups of second feeds are included, where centers of an $n^{th}$ group of second feeds are evenly placed on an $n^{th}$ circle perpendicular to the axis of the aperture unit, the center of the $n^{th}$ circle is located on the axis of the aperture unit, a distance between a projection of any second feed in the $n^{th}$ group of second feeds on a focal plane and the focal point is $R_n$, the center distance between two adjacent second feeds on the $n^{th}$ circle is $d_n$, radiation apertures of the second feeds are on a same plane, a distance between the radiation apertures of the second feeds and a radiation aperture of the first feed is $\delta_n$, and $\delta_n$ is greater than or equal to zero.

With reference to the eighth possible implementation manner of the first aspect, in a ninth possible implementation manner, wherein $$R_n \text{ meets: } R_n \le F \times \tan\left\{\theta \times \frac{1 + \kappa[D/(4F)]^2}{1[D/(4F)]^2}\right\}; \text{ and}$$

-continued $$d_n \text{ meets: } d_n \le \sqrt{2(R_n^2 + F^2) - 2(R_n^2 + F^2)\cos(\theta/2 + \phi_n/2)},$$

where

F is the focal length of the aperture unit, D is the diameter of the aperture unit, k is a constant less than or equal to 1, $\phi_n$ is a beam angle of an aperture radiation beam of the second feed, and $\theta$ is a beam angle of an aperture radiation beam of the first feed.

In a tenth possible implementation manner of the first aspect, the at least two feeds are placed around a focal point of the aperture unit, and after a beam sent by any feed of the at least two feeds is reflected or refracted by the aperture unit, an angle is formed between the beam and the axis of the aperture unit.

With reference to the tenth possible implementation manner of the first aspect, in an eleventh possible implementation manner, centers of the at least two feeds are evenly placed on a circle perpendicular to the axis of the aperture unit, the center of the circle is located on the axis of the aperture unit, a distance between a projection of the feed on a focal plane and the focal point is R, the focal plane is a plane that is perpendicular to the axis of the aperture unit and at which the focal point is located, the center distance between two adjacent feeds is d, a distance between the feed and the focal point is $\delta$, and $\delta$ is greater than or equal to zero.

With reference to the eleventh possible implementation manner of the first aspect, in a twelfth possible implementation manner, $$R \text{ meets: } R \le F \times \tan\left\{\frac{\theta}{2} \times \frac{1 + k[D/(4F)]^2}{1 + [D/(4F)]^2}\right\}; \text{ and}$$

$$d \text{ meets: } d \le \sqrt{2(R^2 + F^2) - 2(R^2 + F^2)\cos(\theta/2 + \phi/2)},$$

where

F is the focal length of the aperture unit, D is the diameter of the aperture unit, k is a constant less than or equal to 1, $\phi$ is a beam angle of an aperture radiation beam of the feed, and $\theta$ is a beam angle of an outgoing radiation beam from the focal point.

With reference to the tenth possible implementation manner of the first aspect, in a thirteenth possible implementation manner, the at least two feeds include two groups, where centers of a first group of feeds are evenly placed on a first circle perpendicular to the axis of the aperture unit, the center of the first circle is located on the axis of the aperture unit, a distance between a projection of any feed in the first group of feeds on a focal plane and the focal point is $R_1$, the center distance between two adjacent second feeds on the first circle is $d_1$, and a distance between radiation apertures of the first group of feeds and the focal point is $\delta_1$; centers of a second group of feeds are evenly placed on a second circle perpendicular to the axis of the aperture unit, the center of the second circle is located on the axis of the aperture unit, a distance between a projection of any feed in the second group of feeds on the focal plane and the focal point is $R_2$, the center distance between two adjacent second feeds on the second circle is $d_2$, and a distance between radiation apertures of the second group of feeds and the focal point is $\delta_2$; and $\delta_1$ and $\delta_2$ are greater than or equal to zero.

With reference to the thirteenth possible implementation manner of the first aspect, in a fourteenth possible implementation manner, $$R_1 \text{ meets: } R_1 \le F \times \tan\left\{\frac{\theta}{2} \times \frac{1 + k[D/(4F)]^2}{1 + [D/(4F)]^2}\right\};$$

$$d_1 \text{ meets: } d_1 \le \sqrt{2(R_1^2 + F^2) - 2(R_1^2 + F^2)\cos(\theta/2 + \phi_1/2)};$$

$$R_2 \text{ meets: } R_2 \le R_1 + F \times \tan\left\{\frac{\theta}{2} \times \frac{1 + k[D/(4F)]^2}{1 + [D/(4F)]^2}\right\}; \text{ and}$$

$$d_2 \text{ meets: } d_2 \le \sqrt{2(R_2^2 + F^2) - 2(R_2^2 + F^2)\cos(\theta/2 + \phi_2/2)},$$

where

F is the focal length of the aperture unit, D is the diameter of the aperture unit, k is a constant less than or equal to 1, a beam angle of an aperture radiation beam of the first group of feeds is $\phi_1$, a beam angle of an aperture radiation beam of the second group of feeds is $\phi_2$, and θ is a beam angle of an outgoing radiation beam from the focal point.

With reference to the tenth possible implementation manner of the first aspect, in a fifteenth possible implementation manner, the at least two feeds include n groups of feeds, where centers of an $n^{th}$ group of feeds are evenly placed on an $n^{th}$ circle perpendicular to the axis of the aperture unit, the center of the $n^{th}$ circle is located on the axis of the aperture unit, a distance between a projection of any feed in the $n^{th}$ group of feeds on a focal plane and the focal point is $R_n$, the center distance between two adjacent feeds on the $n^{th}$ circle is $d_n$, a distance between the feed and the focal point is $\delta_n$, and δ is greater than or equal to zero.

With reference to the fifteenth possible implementation manner of the first aspect, in a sixteenth possible implementation manner, $$R_n \text{ meets: } R_n \le R_{n-1} + F \times \tan\left\{\frac{\theta}{2} \times \frac{1 + \kappa[D/(4F)]^2}{1 + [D/(4F)]^2}\right\}; \text{ and}$$

$$d_n \text{ meets: } d_n \le \sqrt{2(R_n^2 + F^2) - 2(R_n^2 + F^2)\cos(\theta/2 + \phi_n/2)},$$

where

F is the focal length of the aperture unit, D is the diameter of the aperture unit, k is a constant less than or equal to 1, $\phi_n$ is a beam angle of an aperture radiation beam of the feed, and θ is a beam angle of an outgoing radiation beam from the focal point.

With reference to the first aspect or any one of the first to sixteenth possible implementation manners of the first aspect, in a seventeenth possible implementation manner, the feed switching module is a radio frequency switch or a Butler matrix switch.

With reference to the first aspect or any one of the first to seventeenth possible implementation manners of the first aspect, in an eighteenth possible implementation manner, the signal quality includes:

any one or a combination of two or more of power strength of a signal, a signal-to-noise ratio SNR of the signal, and a mean square error MSE of the signal.

In the embodiments of the present application, a second aspect provides a beam scan system, including:

a baseband processing module, an intermediate radio frequency transceiver module, and a beam scanning antenna, where the baseband processing module is connected to the intermediate radio frequency transceiver module, and the baseband processing module is configured to perform modulation and demodulation on transmitted and received signals respectively, and implement service processing according to the transmitted and received signals;

the intermediate radio frequency transceiver module is configured to implement separation of the received and transmitted signals;

the beam scanning antenna is connected to the intermediate radio frequency transceiver module, and the beam scanning antenna includes: a multi-feed antenna, a feed switching module, and a switching control module, where the multi-feed antenna includes an aperture unit and at least two feeds, where the feeds are configured to radiate an electromagnetic wave signal, and the aperture unit is configured to focus the electromagnetic wave signal by means of reflection or refraction;

the feed switching module includes multiple switches, where each feed is respectively connected to one switch; and the switching control module is connected to the feed switching module, and the switching control module is configured to enable, by using the feed switching module, each feed to perform signal quality detection, and select one feed having the best signal quality as a working feed.

In the embodiments of the present application, a third aspect provides a beam scanning method, including:

instructing, by a switching control module, a feed switching module to enable each feed in a multi-feed antenna, so that the feeds separately perform signal quality detection, where the multi-feed antenna includes an aperture unit and at least two feeds, where the feeds are configured to radiate an electromagnetic wave signal, the feed switching module includes multiple switches, and each feed is respectively connected to one switch in the feed switching module;

acquiring, by the switching control module, a result of the signal quality detection performed by each feed; and selecting, by the switching control module according to the result of the signal quality detection, one feed having the best signal quality as a working feed.

In a first possible implementation manner of the third aspect, the at least two feeds include one first feed and at least one second feed;

the first feed is placed at a focal point of the aperture unit, and after being reflected or refracted by the aperture unit, a beam sent by the first feed is parallel to the axis of the aperture unit; and the second feed is placed at a periphery of the first feed, and after a beam sent by the second feed is reflected or refracted by the aperture unit, an angle is formed between the beam and the axis of the aperture unit.

With reference to the first possible implementation manner of the third aspect, in a second possible implementation manner, centers of the second feeds are evenly placed on a circle perpendicular to the axis of the aperture unit, the center of the circle is located on the axis of the aperture unit, a distance between a projection of the second feed on a focal plane and the focal point is R, the focal plane is a plane that is perpendicular to the axis of the aperture unit and at which the focal point is located, the center distance between two adjacent second feeds is d, radiation apertures of the second feeds are on a same plane, a distance between the radiation apertures of the second feeds and a radiation aperture of the first feed is δ, and δ is greater than or equal to zero.

With reference to the second possible implementation manner of the third aspect, in a third possible implementation manner, $$R \text{ meets: } R \le F \times \tan\left\{\theta \times \frac{1 + k[D/(4F)]^2}{1 + [D/(4F)]^2}\right\}; \text{ and}$$

$$d \text{ meets: } d \le \sqrt{2(R^2 + F^2) - 2(R^2 + F^2)\cos(\theta/2 + \phi/2)},$$

where

F is the focal length of the aperture unit, D is the diameter of the aperture unit, k is a constant less than or equal to 1, $\phi$ is a beam angle of an aperture radiation beam of the second feed, and $\theta$ is a beam angle of an aperture radiation beam of the first feed.

With reference to the first possible implementation manner of the third aspect, in a fourth possible implementation manner, two groups of second feeds are included, where centers of a first group of second feeds are evenly placed on a first circle perpendicular to the axis of the aperture unit, the center of the first circle is located on the axis of the aperture unit, a distance between a projection of any second feed in the first group of second feeds on a focal plane and the focal point is $R_1$, the center distance between two adjacent second feeds on the first circle is $d_1$, and a distance between radiation apertures of the first group of second feeds and a radiation aperture of the first feed is $\delta_1$; centers of a second group of second feeds are evenly placed on a second circle perpendicular to the axis of the aperture unit, the center of the second circle is located on the axis of the aperture unit, a distance between a projection of any second feed in the second group of second feeds on the focal plane and the focal point is $R_2$, the focal plane is a plane that is perpendicular to the axis of the aperture unit and at which the focal point is located, the center distance between two adjacent second feeds on the second circle is $d_2$, and a distance between the radiation apertures of the second group of second feeds and the radiation aperture of the first feed is $\delta_2$; and $\delta_1$ and $\delta_2$ are greater than or equal to zero.

With reference to the fourth possible implementation manner of the third aspect, in a fifth possible implementation manner, $$R_1 \text{ meets: } R_1 \le F \times \tan\left\{\theta \times \frac{1 + k[D/(4F)]^2}{1 + [D/(4F)]^2}\right\};$$

$$R_2 \text{ meets: } R_2 \le F \times \tan\left\{\theta \times \frac{1 + k[D/(4F)]^2}{1 + [D/(4F)]^2}\right\};$$

$$d_1 \text{ meets: } d_1 \le \sqrt{2(R_1^2 + F^2) - 2(R_1^2 + F^2)\cos(\theta/2 + \phi_1/2)}; \text{ and}$$

$$d_2 \text{ meets: } d_2 \le \sqrt{2(R_2^2 + F^2) - 2(R_2^2 + F^2)\cos(\theta/2 + \phi_2/2)},$$

where

F is the focal length of the aperture unit, D is the diameter of the aperture unit, k is a constant less than or equal to 1, $\phi_1$ is a beam angle of an aperture radiation beam of the first group of second feeds, $\phi_2$ is a beam angle of an aperture radiation beam of the second group of second feeds, and $\theta$ is a beam angle of an aperture radiation beam radiated by the first feed.

With reference to the first possible implementation manner of the third aspect, in a sixth possible implementation manner, n groups of second feeds are included, where centers of an $n^{th}$ group of second feeds are evenly placed on an $n^{th}$ circle perpendicular to the axis of the aperture unit, the center of the $n^{th}$ circle is located on the axis of the aperture unit, a distance between a projection of any second feed in the $n^{th}$ group of second feeds on a focal plane and the focal point is $R_n$, the center distance between two adjacent second feeds on the $n^{th}$ circle is $d_n$, radiation apertures of the second feeds are on a same plane, a distance between the radiation apertures of the second feeds and a radiation aperture of the first feed is $\delta_n$, and $\delta_n$ is greater than or equal to zero.

With reference to the sixth possible implementation manner of the third aspect, in a seventh possible implementation manner, $$R_n \le F \times \tan\left\{\theta \times \frac{1 + \kappa[D/(4F)]^2}{1 + [D/(4F)]^2}\right\};$$

$$d_n \text{ meets: } d_n \le \sqrt{2(R_n^2 + F^2) - 2(R_n^2 + F^2)\cos(\theta/2 + \phi_n/2)},$$

where

F is the focal length of the aperture unit, D is the diameter of the aperture unit, k is a constant less than or equal to 1, $\phi_n$ is a beam angle of an aperture radiation beam of the second feed, and $\theta$ is a beam angle of an aperture radiation beam of the first feed.

In an eighth possible implementation manner of the third aspect, the at least two feeds are placed around a focal point of the aperture unit, and after a beam sent by any feed of the at least two feeds is reflected or refracted by the aperture unit, an angle is formed between the beam and the axis of the aperture unit.

With reference to the eighth possible implementation manner of the third aspect, in a ninth possible implementation manner, centers of the at least two feeds are evenly placed on a circle perpendicular to the axis of the aperture unit, the center of the circle is located on the axis of the aperture unit, a distance between a projection of the feed on a focal plane and the focal point is R, the focal plane is a plane that is perpendicular to the axis of the aperture unit and at which the focal point is located, the center distance between two adjacent feeds is d, a distance between the feed and the focal point is $\delta$, and $\delta$ is greater than or equal to zero.

With reference to the ninth possible implementation manner of the third aspect, in a tenth possible implementation manner, $$R \textit{ meets: } R \le F \times \tan\left\{\frac{\theta}{2} \times \frac{1 + k[D/(4F)]^2}{1 + [D/(4F)]^2}\right\}; \text{ and}$$

$$d \text{ meets: } d \le \sqrt{2(R^2 + F^2) - 2(R^2 + F^2)\cos(\theta/2 + \phi/2)},$$

where

F is the focal length of the aperture unit, D is the diameter of the aperture unit, k is a constant less than or equal to 1, $\phi$ is a beam angle of an aperture radiation beam of the feed, and $\theta$ is a beam angle of an outgoing radiation beam from the focal point.

With reference to the eighth possible implementation manner of the third aspect, in an eleventh possible implementation manner, the at least two feeds include two groups, where centers of a first group of feeds are evenly placed on a first circle perpendicular to the axis of the aperture unit, the center of the first circle is located on the axis of the aperture unit, a distance between a projection of any feed in the first group of feeds on a focal plane and the focal point is $R_1$, the center distance between two adjacent second feeds on the first circle is $d_1$, and a distance between radiation apertures of the first group of feeds and the focal point is $\delta_1$; centers of a second group of feeds are evenly placed on a second circle perpendicular to the axis of the aperture unit, the center of the second circle is located on the axis of the aperture unit, a distance between a projection of any feed in the second group of feeds on the focal plane and the focal point is $R_2$, the center distance between two adjacent second feeds on the second circle is $d_2$, and a distance between radiation apertures of the second group of feeds and the focal point is $\delta_2$; and $\delta_1$ and $\delta_2$ are greater than or equal to zero.

With reference to the eleventh possible implementation manner of the third aspect, in a twelfth possible implementation manner, $$R_1 \text{ meets: } R_1 \le F \times \tan\left\{\frac{\theta}{2} \times \frac{1 + k[D/(4F)]^2}{1 + [D/(4F)]^2}\right\};$$

$$d_1 \text{ meets: } d_1 \le \sqrt{2(R_1^2 + F^2) - 2(R_1^2 + F^2)\cos(\theta/2 + \phi_1/2)};$$

$$R_2 \text{ meets: } R_2 \le R_1 + F \times \tan\left\{\frac{\theta}{2} \times \frac{1 + k[D/(4F)]^2}{1 + [D/(4F)]^2}\right\}; \text{ and}$$

$$d_2 \text{ meets: } d_2 \le \sqrt{2(R_2^2 + F^2) - 2(R_2^2 + F^2)\cos(\theta/2 + \phi_2/2)},$$

where

F is the focal length of the aperture unit, D is the diameter of the aperture unit, k is a constant less than or equal to 1, a beam angle of an aperture radiation beam of the first group of feeds is $\phi_1$, a beam angle of an aperture radiation beam of the second group of feeds is $\phi_2$, and $\theta$ is a beam angle of an outgoing radiation beam from the focal point.

With reference to the eighth possible implementation manner of the third aspect, in a thirteenth possible implementation manner, the at least two feeds include n groups of feeds, where centers of an $n^{th}$ group of feeds are evenly placed on an $n^{th}$ circle perpendicular to the axis of the aperture unit, the center of the $n^{th}$ circle is located on the axis of the aperture unit, a distance between a projection of any feed in the $n^{th}$ group of feeds on a focal plane and the focal point is $R_n$, the center distance between two adjacent feeds on the $n^{th}$ circle is $d_n$, a distance between the feed and the focal point is $\delta_n$, and $\delta$ is greater than or equal to zero.

With reference to the thirteenth possible implementation manner of the third aspect, in a fourteenth possible implementation manner, $$R_n \text{ meets: } R_n \le R_{n-1} + F \times \tan\left\{\frac{\theta}{2} \times \frac{1 + \kappa[D/(4F)]^2}{1 + [D/(4F)]^2}\right\}; \text{ and}$$

$$d_n \text{ meets: } d_n \le \sqrt{2(R_n^2 + F^2) - 2(R_n^2 + F^2)\cos(\theta/2 + \phi_n/2)},$$

where

F is the focal length of the aperture unit, D is the diameter of the aperture unit, k is a constant less than or equal to 1, $\phi_n$ is a beam angle of an aperture radiation beam of the feed, and $\theta$ is a beam angle of an outgoing radiation beam from the focal point.

With reference to the third aspect or any one of the first to fourteenth possible implementation manners of the third aspect, in a fifteenth possible implementation manner, where after the selecting, according to the result of the signal quality detection, one feed having the best signal quality as a working feed, the method further includes: detecting whether the feed having the best signal quality changes, and if yes, reselecting one feed having the best signal quality as the working feed.

With reference to the fifteenth possible implementation manner of the third aspect, in a sixteenth possible implementation manner, the detecting whether the feed having the best signal quality changes specifically includes:

instructing, at an interval of preset duration, the feed switching module to traverse the feeds, so that each enabled feed separately performs signal quality detection, and determines, according to a result of the signal quality detection, whether the feed having the best signal quality changes; or receiving a user instruction, and instructing, according to the user instruction, the feed switching module to traverse the feeds, so that each enabled feed separately performs signal quality detection, and determines, according to a result of the signal quality detection, whether the feed having the best signal quality changes; or monitoring received signal quality in real time, and when it is detected that received signal quality of a current working feed is less than a preset threshold, instructing the feed switching module to traverse the feeds, so that each enabled feed separately performs signal quality detection, and determines, according to a result of the signal quality detection, whether the feed having the best signal quality changes.

With reference to the third aspect or any one of the first to sixteenth possible implementation manners of the third aspect, in a seventeenth possible implementation manner, the signal quality includes:

any one or a combination of two or more of power strength of a signal, a signal-to-noise ratio SNR of the signal, and a mean square error MSE of the signal.

As can be seen from the foregoing technical solutions, the embodiments of the present application have the following advantages:

In the embodiments of the present application, multiple feeds are placed in an antenna, where each feed corresponds to one beam direction, and the antenna further includes: a feed switching module, configured to control feed switching to implement switching of a beam direction; and a switching control module, which may select, by using the feed switching module, one feed having the best signal quality as a working feed, thereby implementing alignment of antenna beams.

BRIEF DESCRIPTION OF DRAWINGS

To describe the technical solutions in the embodiments of the present disclosure more clearly, the following briefly describes the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. Apparently, the described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
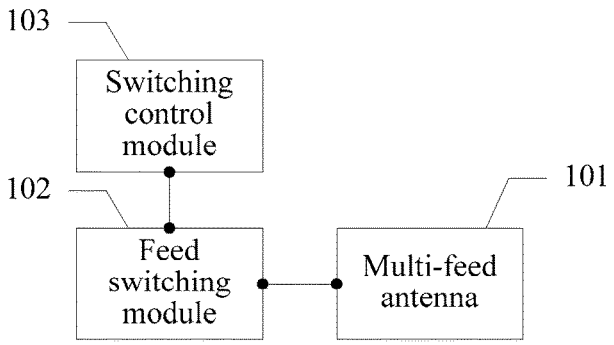
FIG. 1 is a schematic structural diagram of a beam scanning antenna according to an embodiment of the present application.

Referring to FIG. 1, in the embodiments of the present application, an embodiment of a beam scanning antenna includes:

a multi-feed antenna 101, a feed switching module 102, and a switching control module 103.

The multi-feed antenna 101 includes at least two feeds and one aperture unit, where the feeds are configured to radiate an electromagnetic wave signal, and the aperture unit is configured to focus the electromagnetic wave signal by means of reflection or refraction. The aperture unit may be a reflective surface or a lens.

Exemplarily, the at least two feeds include one first feed and at least one second feed. The first feed may be placed at a focal point of the aperture unit, and after being reflected or refracted by the aperture unit, a beam sent by the first feed is parallel to the axis of the aperture unit. The second feed may be placed at a periphery of the first feed, and after a beam sent by the second feed is reflected or refracted by the aperture unit, an angle is formed between the beam and the axis of the aperture unit. Specifically, a value of the angle is related to an offset distance and an azimuth of each feed relative to the focal point. Because each second feed is placed at a different position around the focal point, a direction of a reflected beam of each second feed is also different, so that the second feeds and the first feed together form a relatively large beam coverage range.

Figure 2:
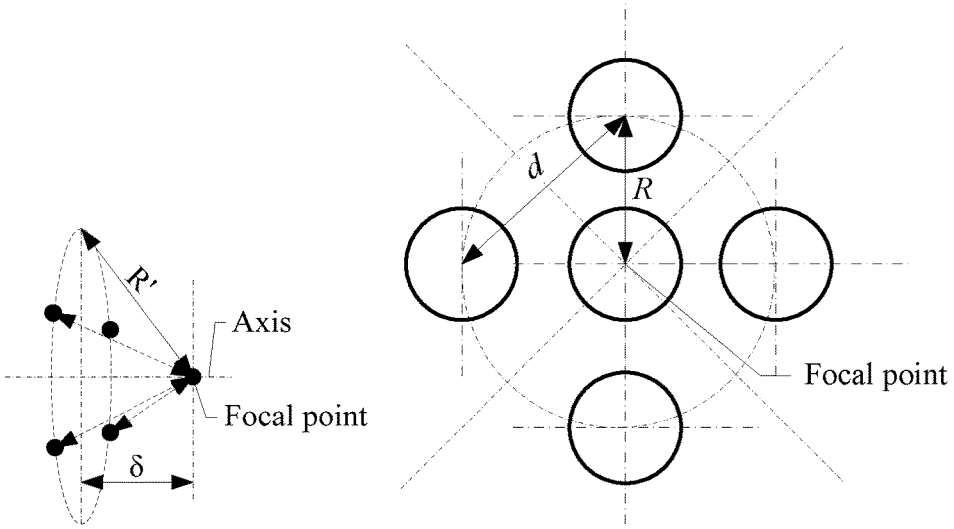
FIG. 2 is a schematic layout diagram of a beam scanning antenna according to an embodiment of the present application.

Specifically, in a feed arrangement manner shown in FIG. 2, a schematic diagram of feed arrangement is provided on a left side of FIG. 2, and a schematic diagram of a position of a feed projected on a focal plane is provided on a right side of FIG. 2. The focal plane is a plane that is perpendicular to the axis of the aperture unit and at which the focal point is located. The feeds include: one first feed and a group of second feeds. Centers of the second feeds are evenly placed on a circle perpendicular to the axis of the aperture unit, the center of the circle is located on the axis of the aperture unit, and a distance between a projection of the second feed on the focal plane and the focal point is R (as shown in the schematic diagram on the left side of FIG. 2). When the first feed is placed at the focal point, a half-power angle of an aperture radiation beam is θ, and a corresponding gain is G dBi. The center distance between two adjacent second feeds is d, radiation apertures of the second feeds are on a same plane, a distance between the radiation apertures of the second feeds and a radiation aperture of the first feed is δ (δ≥0, and when δ=0, the second feed and the radiation aperture of the first feed are on a same plane), and a beam angle of an aperture radiation beam corresponding to the second feed is marked as ϕ. To ensure that seamless coverage of half-power beams can be implemented during beam scanning, the following needs to be met:

$$R \le F \times \tan\left\{\theta \times \frac{1 + k[D/(4F)]^2}{1 + [D/(4F)]^2}\right\}; \text{ and}$$

$$d \le \sqrt{2(R^2 + F^2) - 2(R^2 + F^2)\cos(\theta/2 + \phi/2)},$$

where

F is the focal length of the aperture unit, D is the diameter of the aperture unit, and k is a constant less than or equal to 1. In this case, a seamless scanning range maximally can cover an angle of 3θ. A value of δ needs to make a gain in a main lobe direction of the aperture radiation beam corresponding to the second feed be greater than (G−3) dBi.

Figure 3:
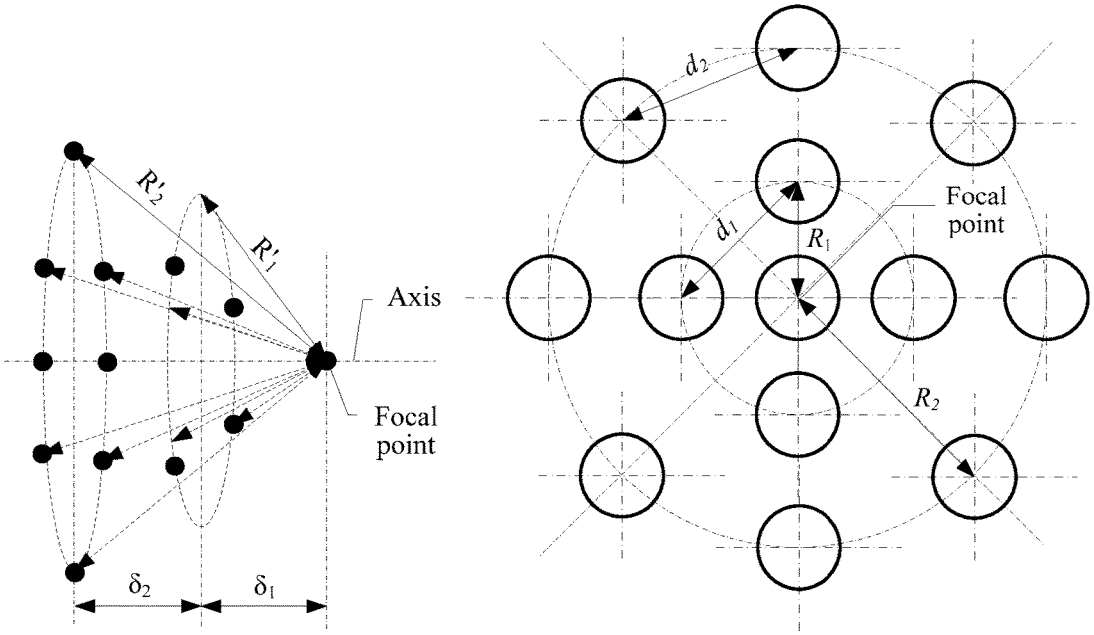
FIG. 3 is another schematic layout diagram of a beam scanning antenna according to an embodiment of the present application.

Specifically, in another feed arrangement manner shown in FIG. 3, a schematic diagram of feed arrangement is provided on a left side of FIG. 3, and a schematic diagram of a position of a feed projected on a focal plane is provided on a right side of FIG. 3. The feeds include: one first feed and two groups of second feeds. Centers of a first group of second feeds are evenly placed on a circle perpendicular to the axis of the aperture unit, the center of the circle is located on the axis of the aperture unit, a distance between a projection of any feed in the first group of feeds on the focal plane and the focal point is $R_1$, the center distance between two adjacent second feeds is $d_1$, and a beam angle of an aperture radiation beam corresponding to the first group of second feeds is $\phi_1$. Centers of a second group of second feeds are evenly placed on another circle perpendicular to the axis of the aperture unit, the center of the circle is located on the axis of the aperture unit, a distance between a projection of any second feed in the second group of feeds on the focal plane and the focal point is $R_2$, the center distance between two adjacent second feeds is $d_2$, and a beam angle of an aperture radiation beam corresponding to the second group of second feeds is $\phi_2$. A distance between radiation apertures of the first group of second feeds and a radiation aperture of the first feed is $\delta_1$ ($\delta_1 \ge 0$), and a distance between radiation apertures of the second group of second feeds and the radiation aperture of the first feed is $\delta_2$ ($\delta_2 \ge 0$). When the first feed is placed at the focal point, a half-power angle of an aperture radiation beam is θ, and a corresponding gain is G dBi. To ensure that seamless coverage of half-power beams can be implemented during beam scanning, the following needs to be met:

$$R_1 \le F \times \tan\left\{\theta \times \frac{1 + k[D/(4F)]^2}{1 + [D/(4F)]^2}\right\};$$

-continued $$d_1 \le \sqrt{2(R_1^2+F^2)-2(R_1^2+F^2)\cos(\theta/2+\phi_1/2)};$$

$$R_2 \le F\times\tan\left\{\theta\times\frac{1+k[D/(4F)]^2}{1+[D/(4F)]^2}\right\}; \text{ and}$$

$$d_2 \le \sqrt{2(R_2^2+F^2)-2(R_2^2+F^2)\cos(\theta/2+\phi_2/2)},$$

where

F is the focal length of the aperture unit, D is the diameter of the aperture unit, and k is a constant less than or equal to 1. In this case, a seamless scanning range maximally can cover an angle of 5θ. Values of $\delta_1$ and $\delta_2$ need to respectively make main lobe direction gains of the aperture radiation beams corresponding to the first and second groups of second feeds be greater than (G-3) dBi.

Further, in an actual application, n groups of second feeds may be placed, and in this case, a seamless scanning range maximally can cover an angle of (2n+1)*θ.

Figure 4:
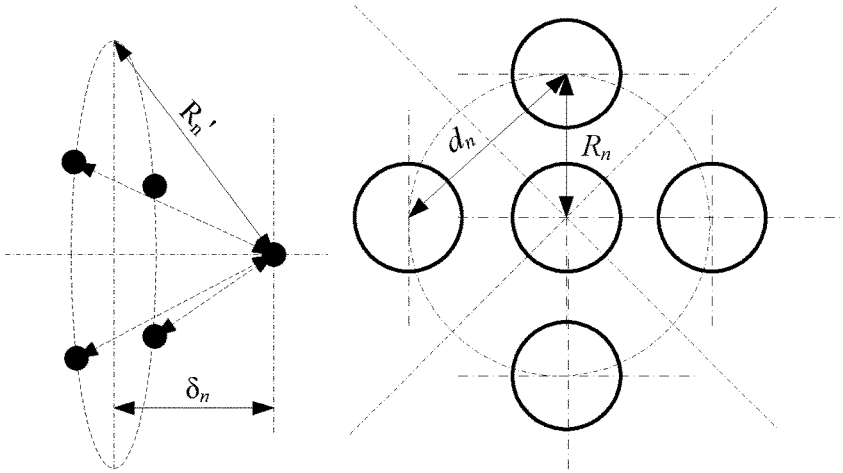
FIG. 4 is another schematic layout diagram of a beam scanning antenna according to an embodiment of the present application.

Specifically, in another feed arrangement manner shown in FIG. 4, a schematic diagram of a position of a feed projected on a focal plane is provided on a left side of FIG. 4, and a schematic diagram of a position of a feed projected on a plane perpendicular to the focal plane is provided on a right side of FIG. 4. The feeds include: one first feed and n groups of second feeds. Centers of an $n^{th}$ group of second feeds are evenly placed on a circle perpendicular to the axis of the aperture unit, the center of the circle is located on the axis of the aperture unit, a distance between a projection of any second feed in the $n^{th}$ group of feeds on the focal plane and the focal point is $R_n$, the center distance between two adjacent second feeds is $d_n$, and a beam angle of an aperture radiation beam corresponding to is $\phi_n$. A distance between the radiation apertures and a radiation aperture of the first feed is $\delta_n$ ($\delta_n \ge 0$). To ensure that seamless coverage of half-power beams can be implemented during beam scanning, the following needs to be met:

$$R_n \le F\times\tan\left\{\theta\times\frac{1+\kappa[D/(4F)]^2}{1+[D/(4F)]^2}\right\}; \text{ and}$$

$$d_n \le \sqrt{2(R_n^2+F^2)-2(R_n^2+F^2)\cos(\theta/2+\phi_n/2)},$$

where a value of $\delta_n$ needs to make a gain in a main lobe direction of the aperture radiation beam corresponding to the $n^{th}$ group of second feeds be greater than (G-3) dBi.

In an actual application, a feed is used as a primary radiator of a high-gain antenna, and focusing of an electromagnetic wave is implemented by means of reflection or refraction by the aperture unit, thereby implementing a high gain of the antenna. In a specific implementation manner, if the aperture unit is a reflective surface, only one primary reflective surface can be used. In this case, the first feed should be located at a focal point of the primary reflective surface, and an arrangement of the at least two feeds should meet the foregoing arrangement manner to implement seamless scanning. A manner of one secondary reflective surface and one primary reflective surface may also be used. In this case, it is considered that the at least two feeds form multiple virtual focal points on a symmetrical surface of the secondary reflective surface, and an arrangement of the multiple virtual focal points should meet the foregoing arrangement manner to implement seamless scanning. If the aperture unit is a lens, in this case, the first feed should be located at a focal point of the lens, and an arrangement of the at least two feeds should meet the foregoing arrangement manner to implement seamless scanning.

Exemplarily, the at least two feeds may further be placed around a focal point of the aperture unit, and after a beam sent by any feed of the at least two feeds is reflected or refracted by the aperture unit, an angle is formed between the beam and the axis of the aperture unit. Specifically, a value of the angle is related to an offset distance and an azimuth of each feed relative to the focal point. Because each feed is placed at a different position around the focal point, a direction of a reflected beam of each feed is also different, so that a relatively large beam coverage range is formed.

Figure 5:
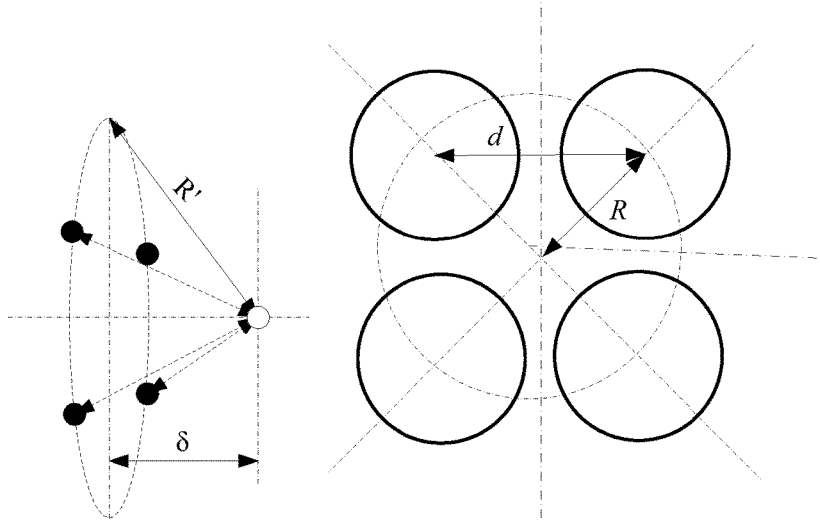
FIG. 5 is another schematic layout diagram of a beam scanning antenna according to an embodiment of the present application.

In another feed arrangement manner shown in FIG. 5, the multi-feed antenna 101 includes at least two feeds. Centers of the at least two feeds are evenly placed on a circle perpendicular to the axis of the aperture unit, and the center of the circle is located on the axis of the aperture unit. A schematic diagram of feed arrangement is provided on a left side of FIG. 5, and a schematic diagram of a position of a feed projected on a focal plane is provided on a right side of FIG. 5. The focal plane is a plane that is perpendicular to the axis of the aperture unit and at which the focal point is located, and a distance between a projection of the feed on a focal plane and the focal point is R. The center distance between two adjacent feeds is d, a distance between radiation apertures of the feeds and the focal point is δ (δ≥0, and when δ=0, the radiation apertures of the feeds are on the focal plane), and a beam angle of an aperture radiation beam corresponding to the feeds is marked as ϕ. It is assumed that when the feeds are placed at the focal point, a half-power angle of the aperture radiation beam is θ, and a corresponding gain is G dBi. To ensure that seamless coverage of half-power beams can be implemented during beam scanning, the following needs to be met:

$$R \le F\times\tan\left\{\frac{\theta}{2}\times\frac{1+k[D/(4F)]^2}{1+[D/(4F)]^2}\right\}; \text{ and}$$

$$d \le \sqrt{2(R^2+F^2)-2(R^2+F^2)\cos(\theta/2+\phi/2)},$$

where

F is the focal length of the aperture unit, D is the diameter of the aperture unit, and k is a constant less than or equal to 1. In this case, a seamless scanning range maximally can cover an angle of 2θ. A value of δ needs to make a gain in a main lobe direction of an aperture radiation beam corresponding to the feeds be greater than (G-3) dBi.

Figure 6:
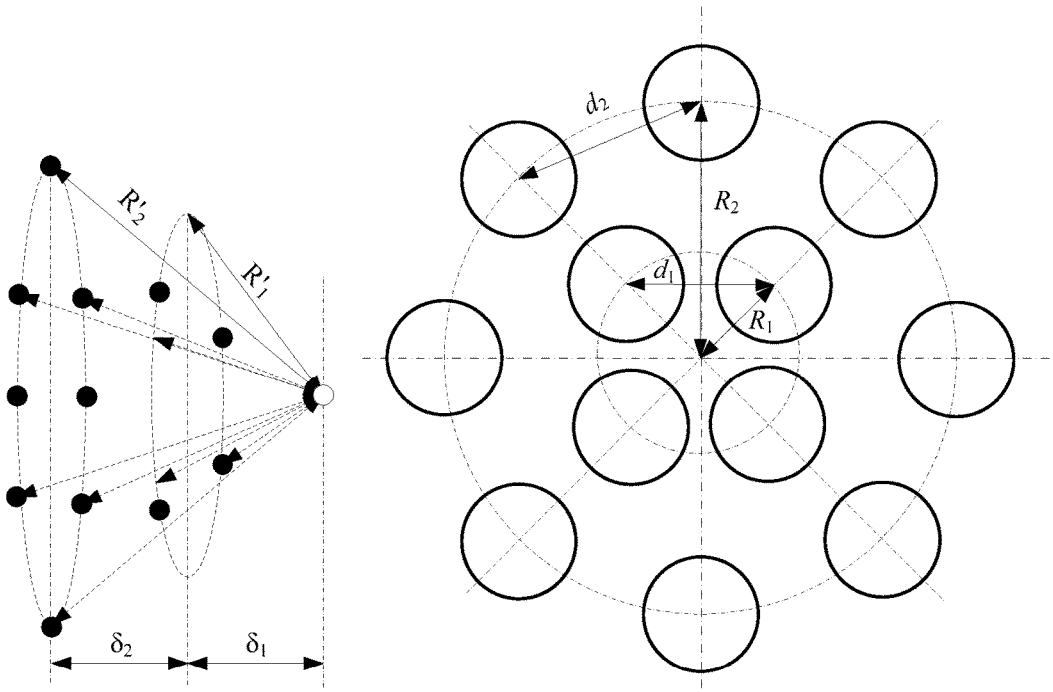
FIG. 6 is another schematic layout diagram of a beam scanning antenna according to an embodiment of the present application.

Specifically, in another feed arrangement manner shown in FIG. 6, a schematic diagram of a position of a feed projected on a focal plane is provided on a left side of FIG. 6, and a schematic diagram of a position of a feed projected on a plane perpendicular to the focal plane is provided on a right side of FIG. 6. The feeds include: two groups of feeds, where centers of a first group of feeds are evenly placed on a circle perpendicular to the axis of the aperture unit, the center of the circle is located on the axis of the aperture unit, a distance between a projection of any feed in the first group of feeds on the focal plane and the focal point is $R_1$, the center distance between two adjacent feeds is $d_1$, and a beam angle of an aperture radiation beam of the first group of feeds is $\phi_1$. Centers of a second group of feeds evenly placed on a circle perpendicular to the axis of the aperture unit, the center of the circle is located on the axis of the aperture unit, a distance between a projection of any feed in the second group of feeds on the focal plane and the focal point is $R_2$, the center distance between two adjacent feeds is $d_2$, a beam angle of an aperture radiation beam of the second group of feeds is $\phi_2$. A distance between radiation apertures of the first group of feeds and the focal point is $\delta_1$ ($\delta_1 \geq 0$), and a distance between radiation apertures of the second group of feeds and the focal point is $\delta_2$ ($\delta_2 \geq 0$). It is assumed that when the feeds are placed at the focal point, a half-power angle of the aperture radiation beam is $\theta$, and a corresponding gain is G dBi. To ensure that seamless coverage of half-power beams can be implemented during beam scanning, the following needs to be met:

$$R_1 \leq F \times \tan\left\{\frac{\theta}{2} \times \frac{1 + k[D/(4F)]^2}{1 + [D/(4F)]^2}\right\};$$

$$d_1 \leq \sqrt{2(R_1^2 + F^2) - 2(R_1^2 + F^2)\cos(\theta/2 + \phi_1/2)};$$

$$R_2 \leq R_1 + F \times \tan\left\{\frac{\theta}{2} \times \frac{1 + k[D/(4F)]^2}{1 + [D/(4F)]^2}\right\}; \text{ and}$$

$$d_2 \leq \sqrt{2(R_2^2 + F^2) - 2(R_2^2 + F^2)\cos(\theta/2 + \phi_2/2)},$$

where

F is the focal length of the aperture unit, D is the diameter of the aperture unit, and k is a constant less than or equal to 1. In this case, a seamless scanning range maximally can cover an angle of $4\theta$. Values of $\delta_1$ and $\delta_2$ need to respectively make main lobe direction gains of the aperture radiation beams corresponding to the first and second groups of feeds be greater than (G-3) dBi.

Further, in an actual application, n groups of feeds may be placed, and in this case, a seamless scanning range maximally can cover an angle of $2n*\theta$.

Figure 7:
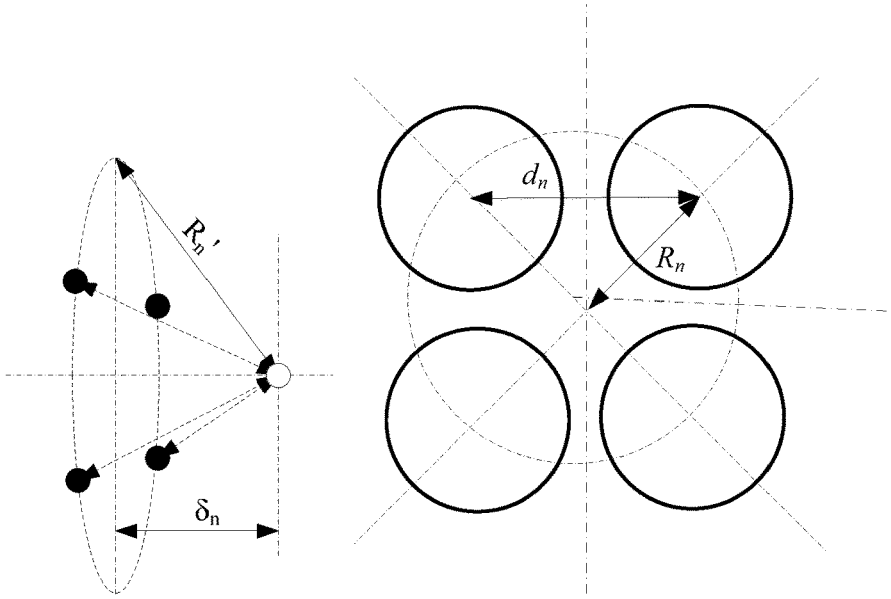
FIG. 7 is another schematic layout diagram of a beam scanning antenna according to an embodiment of the present application.

Specifically, in another feed arrangement manner shown in FIG. 7, a schematic diagram of a position of a feed projected on a focal plane is provided on a left side of FIG. 7, and a schematic diagram of a position of a feed projected on a plane perpendicular to the focal plane is provided on a right side of FIG. 7. The feeds include n groups of feeds. Centers of an $n^{th}$ group of feeds are evenly placed on a circle perpendicular to the axis of the aperture unit, the center of the circle is located on the axis of the aperture unit, a distance between a projection of any feed in the $n^{th}$ group of feeds on the focal plane and the focal point is $R_n$, the center distance between two adjacent feeds is $d_n$, a beam angle of an aperture radiation beam corresponding to is $\phi_n$, and a distance between radiation apertures of the feeds and the focal point is $\delta_n$ ($\delta_n \geq 0$). It is assumed that when the feeds are placed at the focal point, a half-power angle of the aperture radiation beam is $\theta$, and a corresponding gain is G dBi. To ensure that seamless coverage of half-power beams can be implemented during beam scanning, the following needs to be met:

$$R_n \leq R_{n-1} + F \times \tan\left\{\frac{\theta}{2} \times \frac{1 + \kappa[D/(4F)]^2}{1 + [D/(4F)]^2}\right\}; \text{ and}$$

$$d_n \leq \sqrt{2(R_n^2 + F^2) - 2(R_n^2 + F^2)\cos(\theta/2 + \phi_n/2)},$$

where a value of $\delta_n$ needs to make a gain in a main lobe direction of the aperture radiation beam corresponding to the $n^{th}$ group of feeds be greater than (G-3) dBi.

It may be understood that the foregoing description of a position of a feed is only exemplary, and in an actual application, the position of the feed may further have another placement manner, which is not specifically limited herein.

It may be understood that the foregoing description of feeds is only exemplary. It is assumed that in a same group, feeds have a same radiation gain. In an actual application, because individual differences between feeds, or based on a consideration of special design, radiation gains of feeds in a same group may be not completely the same, and a minimum radiation beam angle may be used as a calculation reference.

The feed switching module 102 includes multiple switches, and each feed is respectively connected to one switch in the feed switching module 102.

Exemplarily, the feed switching module may be a radio frequency switch or a Butler (Butler) matrix switch. The radio frequency switch can select only one feed each time. The Butler matrix switch may select one or more feeds at one time. In an actual application, if a Butler matrix switch is used to select multiple feeds at one time, the multiple feeds may be used simultaneously to perform transmission and reception of signals.

The switching control module 103 is configured to enable, by using the feed switching module 102, each feed to perform signal quality detection, and select one feed having the best signal quality as a working feed. That is, the feed switching module 102 keeps a switch of the feed having the best signal quality on within a subsequent period of time. It may be understood that the working feed refers to a feed that actually works in a beam scanning antenna within a period of time, and not that one feed is always used as a feed that always works.

In an actual application, to ensure that an optimal feed configuration can be selected, control logic set in the switching control module 103 needs to ensure that all feeds or feed combinations can be traversed in a feed selection process.

Specifically, the switching control module 103 may further include a beam alignment module 1031, configured to perform switching control by using the feed switching module, and select one feed having the best signal quality as the working feed. In an actual application, the beam alignment module 1031 is a control module, in which the control logic of the feed switching module and logic of selecting a feed may be set. Exemplarily, the beam alignment module 1031 may be a digital signal processing (DSP) or a central processing unit (CPU) module.

Exemplarily, when one of the feeds is selected as the working feed by using the feed switching module 102, a signal transmitted by another microwave system is received, and signal quality detection is then performed on the received signal. Specifically, the signal quality includes: any one or a combination of two or more of a received signal strength, a signal-to-noise ratio (SNR) of a received signal, and a mean square error (MSE) of the received signal. If a received signal strength, for example, a received level or a received power, is detected, the received signal strength is obtained by detecting a signal on a point in a receive link. If an SNR or an MSE is detected, the SNR or the MSE may be obtained by using a baseband demodulation module.

In this embodiment of the present application, multiple feeds are placed, and moreover, and each feed is respectively connected to one switch in a feed switching module; a switching control module may traverse each feed by using the feed switching module to perform signal quality detection, and select one feed having the best signal quality as a working feed, thereby avoiding adjustment and alignment by means of manual rotation of an antenna.

Figure 8:
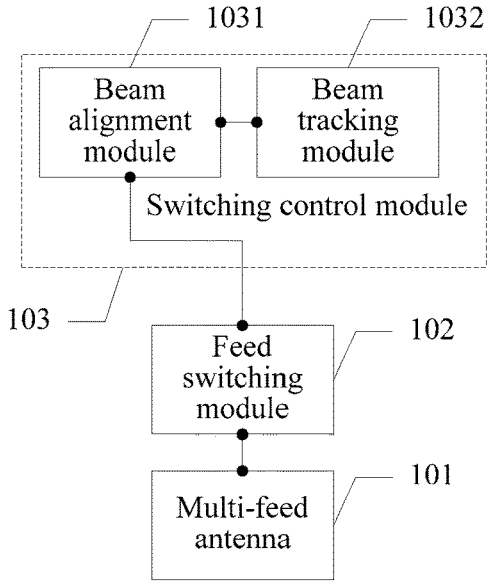
FIG. 8 is another schematic structural diagram of a beam scanning antenna according to an embodiment of the present application.

In an actual application, an antenna in a microwave system may be placed outdoors. Therefore, in a weather of strong wind, the antenna may shake, causing a link interruption easily. An embodiment of the present application provides a corresponding solution. Referring to FIG. 8, in the embodiments of the present application, another embodiment of a beam scanning antenna includes:

a multi-feed antenna 101, a feed switching module 102, and a switching control module 103.

For connection relationships between the multi-feed antenna 101, the feed switching module 102, and the switching control module 103, reference may be made to the embodiment in FIG. 1 above, and details are not described herein again.

Further, the switching control module 103 may further include: a beam alignment module 1031 and a beam tracking module 1032.

The beam alignment module 1031 is configured to perform switching control on the feed switching module by using set control logic, and select one feed having the best signal quality as a working feed.

The beam tracking module 1032 is configured to detect whether the feed having the best signal quality changes, and if yes, notify the beam alignment module 1031 to select one feed having the best signal quality as the working feed.

Specifically, the beam tracking module 1032 instructs the feed switching module 102 to traverse the multiple feeds, and in a traverse process, perform signal quality detection when each feed is enabled, and determine, according to a result of the signal quality detection, whether the feed having the best signal quality changes.

Specifically, the traverse refers to enabling the feeds one by one. When signal quality detection is completed for one feed, switching is performed to another feed to perform signal quality detection.

Specifically, because feed switching needs some time, a process of switching between feeds needs to be performed within a gap period of time of service data processing, or, buffering is performed on service data during switching between feeds, so as to avoid impact on transmission of service data.

Specifically, to avoid that beam scanning antennas at two ends perform scanning simultaneously and cannot be locked, when the beam tracking module 1032 of the beam scanning antenna at a local end starts feed traversal, a first notification message may be sent to the beam scanning antenna at a peer end to notify the peer end that "the local end is currently in a scanning state"; and when the peer end receives the first notification message, a beam tracking module of the peer end locks the beam scanning antenna from performing scanning, that is, keeps the working feed unchanged. When the beam tracking module 1032 at the local end ends feed traversal, the beam tracking module 1032 may also notify the peer end that "currently not in a scanning state", and when the peer end receives the information, the beam tracking module of the peer end unlocks the beam scanning antenna to perform scanning, that is, may start feed traversal according to cases. A notification mechanism for ending feed traversal may be that the local end sends a second notification message to the peer end, or may be that the local end stops sending the first notification message, and the peer end does not receive the first notification message within a preset time and then assumes that "currently not in a scanning state".

Optionally, in an actual application, a fixed period may be set in the beam tracking module 1032, and the feed switching module is instructed at an interval of preset duration to traverse the feeds, so that each enabled feed separately performs signal quality detection, and determines, according to a result of the signal quality detection, whether the feed having the best signal quality changes.

Further, it may also be determined according to degradation of the received signal quality whether signal quality detection needs to be performed. The beam tracking module 1032 monitors received signal quality in real time, and when it is detected that received signal quality of a current working feed is less than a preset threshold, traverses the feeds, so that each enabled feed separately performs signal quality detection, and determines, according to a result of the signal quality detection, whether the feed having the best signal quality changes.

Further, a user may further initiate a procedure of signal quality detection, and the user may send a user instruction to the beam tracking module 1032, to instruct the feed switching module to traverse the feeds, so that each enabled feed separately performs signal quality detection, and determines, according to a result of the signal quality detection, whether the feed having the best signal quality changes.

Figure 9:
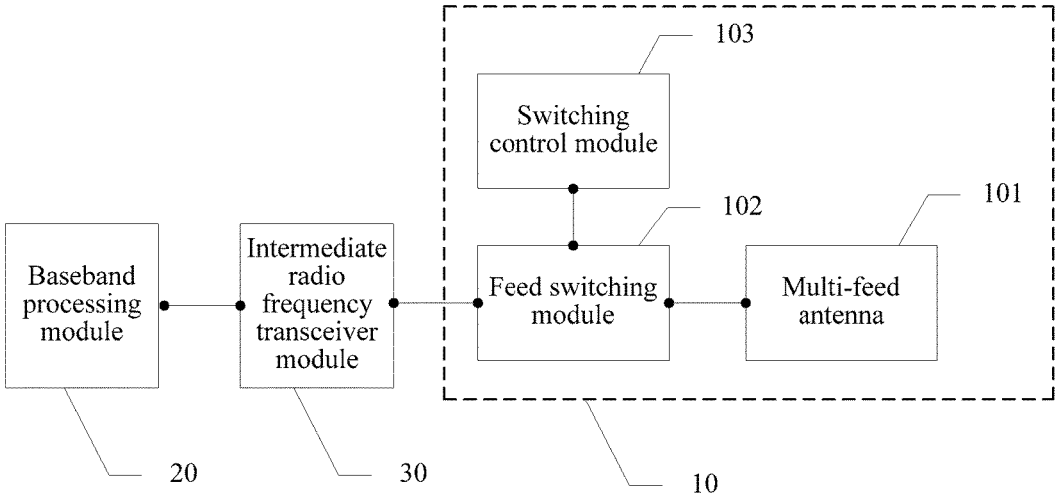
FIG. 9 is a schematic structural diagram of a microwave system according to an embodiment of the present application.

An embodiment of the present application further provides a microwave system including the foregoing beam scanning antenna. Referring to FIG. 9, in the embodiments of the present application, an embodiment of a microwave system includes:

a baseband processing module 20, an intermediate radio frequency transceiver module 30, and a beam scanning antenna 10.

The baseband processing module 20 is connected to the intermediate radio frequency transceiver module 30, and the baseband processing module 20 is configured to perform modulation and demodulation on transmitted and received signals respectively, and implement service processing according to the transmitted and received signals.

The intermediate radio frequency transceiver module 30 is configured to implement separation of the received and transmitted signals. Specifically, the intermediate radio frequency transceiver module 30 includes: a transmit link Tx and a receive link Rx.

The beam scanning antenna 10 is connected to the intermediate radio frequency transceiver module 40, and the beam scanning antenna includes: a multi-feed antenna 101, a feed switching module 102, and a switching control module 103.

The multi-feed antenna 101 includes at least two feeds and one aperture unit. The aperture unit is configured to focus an electromagnetic wave signal by means of reflection or refraction. The aperture unit may be a reflective surface or a lens.

The feed switching module 102 includes multiple switches, and each feed is respectively connected to one switch in the feed switching module 102.

The switching control module 103 is configured to enable, by using the feed switching module 102, each feed to perform signal quality detection, and select one feed having the best signal quality as a working feed. That is, the feed switching module 102 keeps a switch of the feed having the best signal quality on within a subsequent period of time.

It may be understood that the working feed refers to a feed that actually works in a beam scanning antenna within a period of time, and not that one feed is always used as a feed that always works.

In an actual application, to ensure that an optimal feed can be selected, control logic set in the switching control module 103 needs to ensure that all feeds are at least enabled once.

Figure 10:
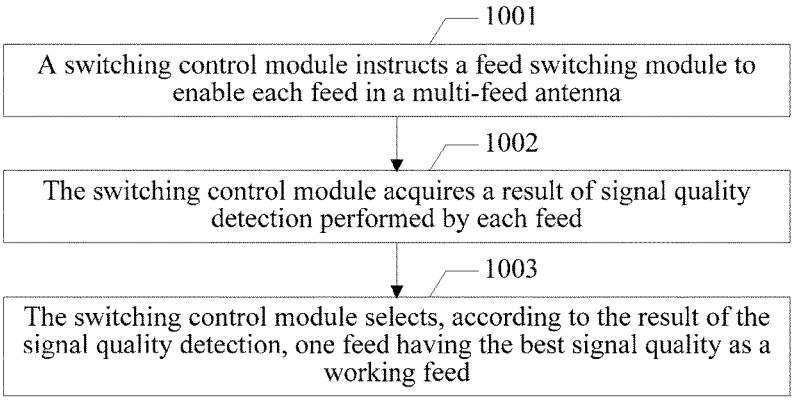
FIG. 10 is a schematic flowchart of a beam alignment method according to an embodiment of the present application.

A beam alignment method is described below. Referring to FIG. 10, in the embodiments of the present application, an embodiment of a beam alignment method includes:

1001: A switching control module instructs a feed switching module to enable each feed in a multi-feed antenna.

A switching control module instructs a feed switching module to enable each feed in a multi-feed antenna, so that the feeds separately perform signal quality detection, where the multi-feed antenna includes an aperture unit and at least two feeds, where the feeds are configured to radiate an electromagnetic wave signal, and the aperture unit is configured to focus the electromagnetic wave signal by means of reflection or refraction. Exemplarily, the aperture unit may be a reflective surface or a lens.

The feed switching module includes multiple switches, and each feed is respectively connected to one switch in the feed switching module.

In this embodiment of the present application, for a position relationship between feeds, refer to the foregoing apparatus embodiments, and details are not described herein again.

Exemplarily, the feed switching module may be a radio frequency switch or a Butler (Butler) matrix switch. The radio frequency switch can select only one feed each time. The Butler matrix switch may select one or more feeds at one time. In an actual application, if a Butler matrix switch is used to select multiple feeds at one time, the multiple feeds may be used simultaneously to perform transmission and reception of signals.

1002: The switching control module acquires a result of signal quality detection performed by each feed.

Exemplarily, when a switch of a feed is turned on, a signal transmitted by a beam scanning antenna at another end is received, and signal quality detection is then performed on the signal. After signal quality detection is completed, the feeds send a result of the signal quality detection to the switching control module.

Specifically, the signal quality includes: any one or a combination of two or more of a received signal strength, a signal-to-noise ratio (SNR) of a received signal, and a mean square error (MSE) of the received signal. If a received signal strength, for example, a received level or a received power, is detected, the received signal strength is obtained by detecting a signal on a point in a receive link. If an SNR or an MSE is detected, the SNR or the MSE may be obtained by using a baseband demodulation module.

1003: The switching control module selects, according to the result of the signal quality detection, one feed having the best signal quality as a working feed.

It may be understood that the working feed refers to a feed that actually works in a beam scanning antenna within a period of time, and not that one feed is always used as a feed that always works.

In an actual application, to ensure that an optimal feed configuration can be selected, control logic set in the switching control module needs to ensure that in a process of feed selection, all feeds or feed combinations can be traversed and enabled at least once.

Optionally, the feed having the best signal quality may be determined according only to any parameter of a power strength of a signal, an SNR of the signal, and an MSE of the signal, that is, a feed having the greatest power strength, or having the highest SNR, or having the minimum MSE is selected. The feed having the best signal quality may also be selected in combination with a condition of any two or more of a power strength of a signal, an SNR of the signal, and an MSE of the signal and with reference to corresponding weights. A specific implementation manner may be decided according to an actual need, and is not limited herein.

In this embodiment of the present application, multiple feeds are placed, and moreover, and each feed is respectively connected to one switch in a feed switching module; a switching control module may enable, by using the feed switching module, each feed to perform signal quality detection, and select one feed having the best signal quality as a working feed, thereby avoiding manual adjustment and alignment of an antenna.

Figure 11:
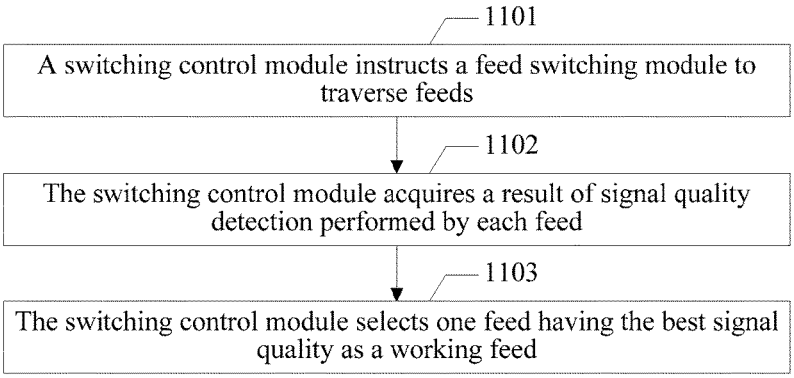
FIG. 11 is another schematic flowchart of a beam alignment method according to an embodiment of the present application.

Further, in an actual application, an antenna in a microwave system may be placed outdoors. Therefore, in a weather of strong wind, the antenna may shake, causing a link interruption easily. An embodiment of the present application provides a corresponding solution. Referring to FIG. 11, in the embodiments of the present application, another embodiment of a beam scanning antenna includes:

1101: A switching control module instructs a feed switching module to traverse the feeds.

The switching control module instructs the feed switching module to traverse the feeds, so that each enabled feed separately performs signal quality detection.

In this embodiment of the present application, for a position relationship between feeds, refer to the foregoing apparatus embodiments, and details are not described herein again.

Specifically, the switching control module may further include: a beam alignment module and a beam tracking module. The beam alignment module is configured to perform switching control on the feed switching module by using set control logic, and select one feed having the best signal quality as the working feed. The beam tracking module is configured to detect whether the feed having the best signal quality changes, and if yes, notify the beam alignment module to select one feed having the best signal quality as the working feed. Specifically, because feed switching needs some time, a process of switching between feeds needs to be performed within a gap period of time of service data processing, or, buffering is performed on service data during switching between feeds, so as to avoid impact on transmission of service data.

Specifically, to avoid that beam scanning antennas at two ends perform scanning simultaneously and cannot be locked, when the beam tracking module of the beam scanning antenna at a local end starts feed traversal, a first notification message may be sent to the beam scanning antenna at a peer end to notify the peer end that "currently in a scanning state"; and when the peer end receives the first notification message, a beam tracking module of the peer end locks the beam scanning antenna from performing scanning, that is, keeps the working feed unchanged. When the beam tracking module at the local end ends feed traversal, the beam tracking module may also notify the peer end that "the local end is currently not in a scanning state", and when the peer end receives the information, the beam tracking module of the peer end unlocks the beam scanning antenna to perform scanning, that is, may start feed traversal according to cases. A notification mechanism for ending feed traversal may be that the local end sends a second notification message to the peer end, or may be that the local end stops sending the first notification message, and the peer end does not receive the first notification message within a preset time and then assumes that "currently not in a scanning state".

Optionally, in an actual application, there are multiple manners of triggering the switching control module to perform signal quality detection on each feed again, and the manners include:

1. Periodic Initiation

A user may set one fixed duration, and set the beam tracking module to instruct, at an interval of preset duration, the feed switching module to traverse the feeds.

2. Initiation According to an Instruction

A user initiates a procedure of signal detection, and the user may send a user instruction to the beam tracking module, to instruct the feed switching module to traverse the feeds. Specifically, the user instruction may be sent by using remote control, a set program or a preset button, and a specific implementation form may be decided according to an actual need, which is not limited herein.

3. Initiation According to Received Signal Quality

The beam tracking module monitors received signal quality in real time, and when it is detected that received signal quality of a current working feed is less than a preset threshold, traverses the feeds, so that each enabled feed separately performs signal quality detection.

1102: The switching control module acquires a result of signal quality detection performed by each feed.

Exemplarily, when a switch of a feed is turned on, a signal transmitted by a beam scanning antenna at another end is received, and signal quality detection is then performed on the signal. After signal quality detection is completed, the feeds send a result of the signal quality detection to the switching control module.

1103: The switching control module selects one feed having the best signal quality as the working feed.

Within one traversal period, the switching control module selects one feed having the best signal quality as the working feed. It may be understood that the working feed refers to a feed that actually works in a beam scanning antenna within a period of time, and not that one feed is always used as a feed that always works.

Specifically, a period of time within which the feeds are sequentially enabled once is one traversal period.

In this embodiment of the present application, a working feed is adjusted according to an actual case, that is, even an antenna in a microwave system shakes and a feed is offset, a switching control module can still automatically reselect one feed having the best signal quality as the working feed, so that signal receive and transmit quality of a microwave link is not severely affected.

The foregoing descriptions are merely specific implementation manners of the present application, but are not intended to limit the protection scope of the present application. Any variation or replacement readily figured out by a person skilled in the art within the technical scope disclosed in the present application shall fall within the protection scope of the present application. Therefore, the protection scope of the present application shall be subject to the protection scope of the claims.

What is claimed is:

1. A beam scanning antenna comprising:

a multi-feed antenna comprising an antenna aperture configured to focus an electromagnetic wave signal by reflection or refraction and at least two feeds configured to radiate the electromagnetic wave signal, wherein a) a first feed is at a focal point of the antenna aperture such that, after being reflected or refracted by the antenna aperture, a beam sent by the first feed is parallel to an axis of the antenna aperture, and b) a second feed is at a periphery of the first feed such that, after being reflected or refracted by the antenna aperture, a beam sent by the second feed forms an angle with respect to the axis of the antenna aperture;

a feed switching assembly comprising multiple switches, wherein each of the first and second feeds is connected to a respective one of the multiple switches; and a switching controller connected to the feed switching assembly and configured to enable, by using the feed switching assembly, each of the first and second feeds to perform signal quality detection, and select one of the first and second feeds having the best signal quality as a working feed based on the signal quality detection.

2. The beam scanning antenna according to claim 1, wherein the switching controller further comprises:

a beam tracker configured to detect whether the feed having the best signal quality changes, and if yes, notify a beam aligner to select one feed having the best signal quality as the working feed.

3. The beam scanning antenna according to claim 2, wherein the beam tracker is configured to:

instruct, at an interval of preset duration, the feed switching assembly to traverse the feeds, so that each enabled feed separately performs signal quality detection, and determines, according to a result of the signal quality detection, whether the feed having the best signal quality changes; or receive a user instruction, and instruct, according to the user instruction, the feed switching assembly to traverse the feeds, so that each enabled feed separately performs signal quality detection, and determines, according to a result of the signal quality detection, whether the feed having the best signal quality changes; or monitor received signal quality in real time, and when it is detected that received signal quality of a current working feed is less than a preset threshold, instruct the feed switching module to traverse the feeds, so that each enabled feed separately performs signal quality detection, and determines, according to a result of the signal quality detection, whether the feed having the best signal quality changes.

4. The beam scanning antenna according to claim 1, wherein centers of the second feeds are evenly placed on a circle perpendicular to the axis of the antenna aperture, the center of the circle is located on the axis of the antenna aperture, a distance between a projection of the second feed on a focal plane and the focal point is R, the focal plane is a plane that is perpendicular to the axis of the antenna aperture and at which the focal point is located, the center distance between two adjacent second feeds is d, radiation apertures of the second feeds are on a same plane, a distance between the radiation apertures of the second feeds and a radiation aperture of the first feed is δ, and δ is greater than or equal to zero;

$$\text{wherein R meets: } R \le F \times \tan\left\{\theta \times \frac{1 + k[D/(4F)]^2}{1 + [D/(4F)]^2}\right\}; \text{ and}$$

$$\text{wherein d meets: } d \le \sqrt{2(R^2 + F^2) - 2(R^2 + F^2)\cos(\theta/2 + \phi/2)},$$

wherein F is the focal length of the antenna aperture, D is the diameter of the antenna aperture, k is a constant less than or equal to 1, ϕ is a beam angle of an aperture radiation beam of the second feed, and θ is a beam angle of an aperture radiation beam of the first feed.

5. The beam scanning antenna according to claim 1, wherein the at least two feeds are placed around a focal point of the antenna aperture, and after a beam sent by any feed of the at least two feeds is reflected or refracted by the antenna aperture, an angle is formed between the beam and the axis of the antenna aperture.

6. The beam scanning antenna according to claim 5, wherein centers of the at least two feeds are evenly placed on a circle perpendicular to the axis of the antenna aperture, the center of the circle is located on the axis of the antenna aperture, a distance between a projection of the feed on a focal plane and the focal point is R, the focal plane is a plane that is perpendicular to the axis of the antenna aperture and at which the focal point is located, the center distance between two adjacent feeds is d, a distance between the feed and the focal point is δ, and δ is greater than or equal to zero;

$$\text{wherein R meets: } R \le F \times \tan\left\{\frac{\theta}{2} \times \frac{1 + k[D/(4F)]^2}{1 + [D/(4F)]^2}\right\}; \text{ and}$$

$$\text{wherein d meets: } d \le \sqrt{2(R^2 + F^2) - 2(R^2 + F^2)\cos(\theta/2 + \phi/2)},$$

wherein F is the focal length of the antenna aperture, D is the diameter of the aperture unit, k is a constant less than or equal to 1, ϕ is a beam angle of an aperture radiation beam of the feed, and θ is a beam angle of an outgoing radiation beam from the focal point.

7. The beam scanning antenna according to claim 1, wherein the feed switching assembly is a radio frequency switch or a Butler matrix switch.

8. A microwave system comprising:

a baseband processor connected to an intermediate radio frequency transmitter and receiver, and the baseband processor is configured to perform modulation and demodulation on transmitted and received signals, respectively, and implement service processing according to the transmitted and received signals wherein the intermediate radio frequency transmitter and receiver is configured with the processor to implement separation of the transmitted and received signals;

a beam scanning antenna connected to the intermediate radio frequency transmitter and receiver, and the beam scanning antenna comprising a multi-feed antenna that includes an antenna aperture and at least one first feed and at least one second feed configured to radiate an electromagnetic wave signal, wherein a) the antenna aperture is configured to focus the electromagnetic wave signal by reflection or refraction;

b) the first feed is placed at a focal point of the antenna aperture, and after being reflected or refracted by the antenna aperture, a beam sent by the first feed is parallel to the axis of the antenna aperture; and c) the second feed is placed at a periphery of the first feed, and after a beam sent by the second feed is reflected or refracted by the antenna aperture, an angle is formed between the beam and the axis of the antenna aperture, a feed switching assembly comprising multiple switches, wherein each feed is respectively connected to one switch; and a switching controller connected to the feed switching assembly, and the switching controller is configured to enable, by using the feed switching assembly, each feed to perform signal quality detection, and select one feed having the best signal quality as a working feed based on the signal quality detection.

9. The microwave system according to claim 8, wherein the switching controller further comprises a beam tracker configured to detect whether the feed having the best signal quality changes, and if yes, notify a beam aligner to select one feed having the best signal quality as the working feed.

10. A beam alignment method comprising:

instructing, by a switching controller, a feed switching assembly to enable each feed in a multi-feed antenna, so that each feed performs signal quality detection respectively, wherein the multi-feed antenna comprises an antenna aperture and at least one first feed and at least one second feed configured to radiate an electromagnetic wave signal, wherein a) the first feed is placed at a focal point of the antenna aperture, and after being reflected or refracted by the antenna aperture, a beam sent by the first feed is parallel to the axis of the antenna aperture, b) the second feed is placed at a periphery of the first feed, and after a beam sent by the second feed is reflected or refracted by the antenna aperture, an angle is formed between the beam and the axis of the antenna aperture, c) the feed switching assembly comprises multiple switches, and d) each feed is respectively connected to one switch in the feed switching assembly;

acquiring, by the switching controller, a result of the signal quality detection performed by each feed; and selecting, by the switching controller according to the result of the signal quality detection, one feed having the best signal quality as a working feed.

11. The method according to claim 10, wherein centers of the second feeds are evenly placed on a circle perpendicular to the axis of the antenna aperture, the center of the circle is located on the axis of the antenna aperture, a distance between a projection of the second feed on a focal plane and the focal point is R, the focal plane is a plane that is perpendicular to the axis of the antenna aperture and at which the focal point is located, the center distance between two adjacent second feeds is d, radiation apertures of the second feeds are on a same plane, a distance between the radiation apertures of the second feeds and a radiation aperture of the first feed is δ, and δ is greater than or equal to zero;

$$\text{wherein R meets: } R \le F \times \tan\left\{\theta \times \frac{1 + k[D/(4F)]^2}{1 + [D/(4F)]^2}\right\}; \text{ and}$$

$$\text{wherein d meets: } d \le \sqrt{2(R^2 + F^2) - 2(R^2 + F^2)\cos(\theta/2 + \phi/2)},$$

wherein F is the focal length of the aperture unit, D is the diameter of the antenna aperture, k is a constant less than or equal to 1, ϕ is a beam angle of an aperture radiation beam of the second feed, and θ is a beam angle of an aperture radiation beam of the first feed.

12. The method according to claim 10, wherein the at least two feeds are placed around a focal point of the antenna aperture, and after a beam sent by any feed of the at least two feeds is reflected or refracted by the antenna aperture, an angle is formed between the beam and the axis of the antenna aperture.

13. The method according to claim 12, wherein centers of the at least two feeds are evenly placed on a circle perpendicular to the axis of the antenna aperture, the center of the circle is located on the axis of the antenna aperture, a distance between a projection of the feed on a focal plane and the focal point is R, the focal plane is a plane that is perpendicular to the axis of the antenna aperture and at which the focal point is located, the center distance between two adjacent feeds is d, a distance between the feed and the focal point is δ, and δ is greater than or equal to zero;

$$\text{wherein R meets: } R \le F \times \tan\left\{\frac{\theta}{2} \times \frac{1 + k[D/(4F)]^2}{1 + [D/(4F)]^2}\right\}; \text{ and}$$

$$\text{wherein d meets: } d \le \sqrt{2(R^2 + F^2) - 2(R^2 + F^2)\cos(\theta/2 + \phi/2)},$$

wherein

F is the focal length of the aperture unit, D is the diameter of the antenna aperture, k is a constant less than or equal to 1, ϕ is a beam angle of an aperture radiation beam of the feed, and θ is a beam angle of an outgoing radiation beam from the focal point.

14. The method according to claim 10, after the selecting, according to the result of the signal quality detection, one feed having the best signal quality as a working feed, further comprising:

detecting whether the feed having the best signal quality changes, and if yes, reselecting one feed having the best signal quality as the working feed.

15. The method according to claim 14, wherein the detecting whether the feed having the best signal quality changes comprises:

instructing, at an interval of preset duration, the feed switching assembly to traverse the feeds, so that each enabled feed separately performs signal quality detection, and determining, according to a result of the signal quality detection, whether the feed having the best signal quality changes; or receiving a user instruction, and instructing, according to the user instruction, the feed switching assembly to traverse the feeds, so that each enabled feed separately performs signal quality detection, and determining, according to a result of the signal quality detection, whether the feed having the best signal quality changes; or monitoring received signal quality in real time, and when it is detected that received signal quality of a current working feed is less than a threshold, instructing the feed switching assembly to traverse the feeds, so that each enabled feed separately performs signal quality detection, and determining, according to a result of the signal quality detection, whether the feed having the best signal quality changes.

16. A beam scanning antenna comprising:

a multi-feed antenna comprising an antenna aperture and at least one first feed and at least one second feed configured to radiate an electromagnetic wave signal, wherein a) the antenna aperture is configured to focus the electromagnetic wave signal by reflection or refraction;

b) the first feed is placed at a focal point of the antenna aperture, and after being reflected or refracted by the antenna aperture, a beam sent by the first feed is parallel to the axis of the antenna aperture; and c) the second feed is placed at a periphery of the first feed, and after a beam sent by the second feed is reflected or refracted by the antenna aperture, an angle is formed between the beam and the axis of the antenna aperture;

a feed switch comprising multiple switches, wherein each feed is respectively connected to one switch; and a switching controller connected to the feed switch, and the switching controller is configured to enable, by using the feed switch, each feed to perform signal quality detection, and select one feed having the best signal quality as a working feed based on the signal quality detection.

17. The beam scanning antenna according to claim 16, wherein the switching controller further comprises:

a beam tracker configured to detect whether the feed having the best signal quality changes, and if yes, notify the beam aligner to select one feed having the best signal quality as the working feed.

18. The beam scanning antenna according to claim 17, wherein the beam tracker is configured to instruct, at an interval of preset duration, the feed switch to traverse the feeds, so that each enabled feed separately performs signal quality detection, and determine, according to a result of the signal quality detection, whether the feed having the best signal quality changes.

19. The beam scanning antenna according to claim 17, wherein the beam tracker is configured to receive a user instruction, and instruct, according to the user instruction, the feed switch to traverse the feeds, so that each enabled feed separately performs signal quality detection, and determine, according to a result of the signal quality detection, whether the feed having the best signal quality changes.

20. The beam scanning antenna according to claim 17, wherein the beam tracker is configured to monitor received signal quality in real time, and when it is detected that received signal quality of a current working feed is less than a preset threshold, instruct the feed switch to traverse the feeds, so that each enabled feed separately performs signal quality detection, and determine, according to a result of the signal quality detection, whether the feed having the best signal quality changes.

* * * * *